United States Patent [19]

Godding et al.

[11] 4,352,605

[45] Oct. 5, 1982

[54] MEANS FOR ADDING MATERIALS TO A FLOWING STREAM

[75] Inventors: Ronald G. Godding, West Heath; William McCormack, Studley, both of England

[73] Assignee: BCIRA, Birmingham, England

[21] Appl. No.: 52,740

[22] Filed: Jun. 28, 1979

[30] Foreign Application Priority Data

Jun. 28, 1978 [GB] United Kingdom ..... 28182/78

[51] Int. Cl.[3] ..... B22D 27/20; B65G 53/66

[52] U.S. Cl. ..... 406/29; 75/46; 75/130 R; 164/57.1; 164/154; 266/81; 266/90; 266/216

[58] Field of Search ..... 164/4, 55–58, 164/154, 155, 266; 266/81, 90, 216; 406/12, 19, 29; 75/46, 130 R

[56] References Cited

U.S. PATENT DOCUMENTS

| | | | |
|---|---|---|---|
| 3,224,051 | 12/1965 | Brown, Jr. et al. | 164/57 |
| 3,260,591 | 7/1966 | Brown, Jr. et al. | 75/53 |
| 3,511,490 | 5/1970 | Brown, Jr. | 266/216 |
| 3,592,363 | 7/1971 | Stout et al. | 164/57 X |
| 3,682,131 | 8/1972 | Algeri et al. | 118/682 |
| 3,702,151 | 11/1972 | Blok et al. | 164/57 |
| 3,818,971 | 6/1974 | Schutz | 164/155 X |
| 3,995,681 | 12/1976 | Schmid et al. | 164/154 |

FOREIGN PATENT DOCUMENTS

| | | | |
|---|---|---|---|
| 2408363 | 10/1974 | Fed. Rep. of Germany . | |
| 541573 | 3/1977 | U.S.S.R. | 164/4 |

*Primary Examiner*—Gus T. Hampilos
*Assistant Examiner*—J. Reed Batten, Jr.
*Attorney, Agent, or Firm*—Scrivener, Clarke, Scrivener and Johnson

[57] ABSTRACT

Apparatus for adding materials, especially powdered or granular materials, to a flowing stream, e.g. of molten metal, comprises a nozzle for compressed gas, blowing the additive into the stream, and a detector that detects the stream and switches the flow of additive on and off according to whether the stream is present or absent. The detector is preferably of a non-contact type, sensing radiation from the stream, preferably visible light. The rate of flow of additive can be adjustable. There can be a fail-safe optical detector arrangement monitoring the flow of additive and signalling an alarm if the flow fails or if the nozzle is blocked. The timings of the start and end of the flow in relation to the detection of the metal stream are independently adjustable to ensure that the additive and metal coincide.

2 Claims, 6 Drawing Figures

MEANS FOR ADDING MATERIALS TO A FLOWING STREAM

This invention relates to apparatus for adding materials to a flowing stream of molten metal.

It is known to feed an additive into a stream of flowing metal for various purposes. For example in the manufacture of steel it is known to use a compressed air gun to blow powdered aluminium into the stream of molten steel passing from a ladle into a mould.

In one known example of such an arrangement there is a manually controlled valve in the compressed air supply and the operator turns on the valve when the additive is required and turns it off when he sees that the flow of metal has stopped. In another known proposal, for adding material directly into a container that is being filled with molten metal, a central control system controls simultaneously both the outlet to a metal pouring ladle and a solenoid-operated valve in the compressed air supply used to blow in the additive material.

Such arrangements are inevitably somewhat inaccurate and haphazard, in that an appreciable amount of metal may flow before the additive starts, and equally, at the end of the cycle the additive may be halted too early or too late in relation to the flow of metal.

In the manufacture of nodular graphite cast iron it has been common to add an inoculant, in order to cause nucleation of the graphite in the iron, either in the ladle or in the mould itself. Coating the mould is unsatisfactory and produces uneven results; adding the inoculant in the ladle is also far from perfect and is wasteful as much of the full effect of the added material is lost by fading or oxidation before the molten metal reaches the mould. Another known proposal is to place a predetermined quantity of an additive in the gate or sprue of the mould to be picked up by the metal as it enters, but this can lead to the distribution of the additive within the casting being far from uniform.

It has recently been found that better and more consistent results are produced, and with a lower quantity of inoculant, if it is added as late as possible but still before the metal reaches the mould. This means adding it to the flowing stream of molten metal as it is being poured. As indicated above, apparatus exists for adding materials to a molten stream of metal, but the known apparatus requires manual control and the quantity of material actually added is uncertain.

The aim of the invention is to provide an improved form of apparatus for adding materials, in particular materials in powdered or granular form, to a stream of molten metal in an economical and uniform manner.

According to the invention we propose that such apparatus should comprise a nozzle connectable to a source of compressed gas, means for feeding the additive material into the flow of gas from the nozzle, and a detector which senses the presence and absence of a stream of molten metal at a predetermined location in the path of the flow, the detector controlling the flow of additive material in such a manner that when the stream of molten metal is present at the location the flow of additive material is caused to start and when the stream ceases at the location the flow of additive material is automatically halted.

In this way the additive is fed at a high rate initially and thereafter uniformly throughout the flow of the metal stream yet halted when the flow of metal stops for any reason, and one can therefore be sure that the emerging stream always contains additive to a constant degree.

Preferably the detector senses the presence of the main stream by a non-contact method, for example by sensing radiation from the stream. Although it would be possible to sense the infra-red radiation from the hot metal we find in practice that this can lead to uncertain operation, due to radiation from other hot bodies in the neighbourhood, and so where the metal of the main stream is hot enough to be luminous (as is the case with molten iron) we prefer to sense the visible light.

Preferably the detector senses the flow at a location upstream of the point of entry of the additive, to allow for the time delay inherent in any valves used for initiating flow of the additive and thereby to ensure that the additive and the front of the main flow reach the point of entry simultaneously.

The rate of flow of additive may be made continuously variable, for example automatically in response to means sensing the magnitude of the main stream. Alternatively manual means may be provided for pre-setting the rate of flow, for example by allowing the additive to flow under gravity through a selected one of a range of metering orifices.

The invention will now be described by way of example with reference to the accompanying drawings, in which.

Figure 1:
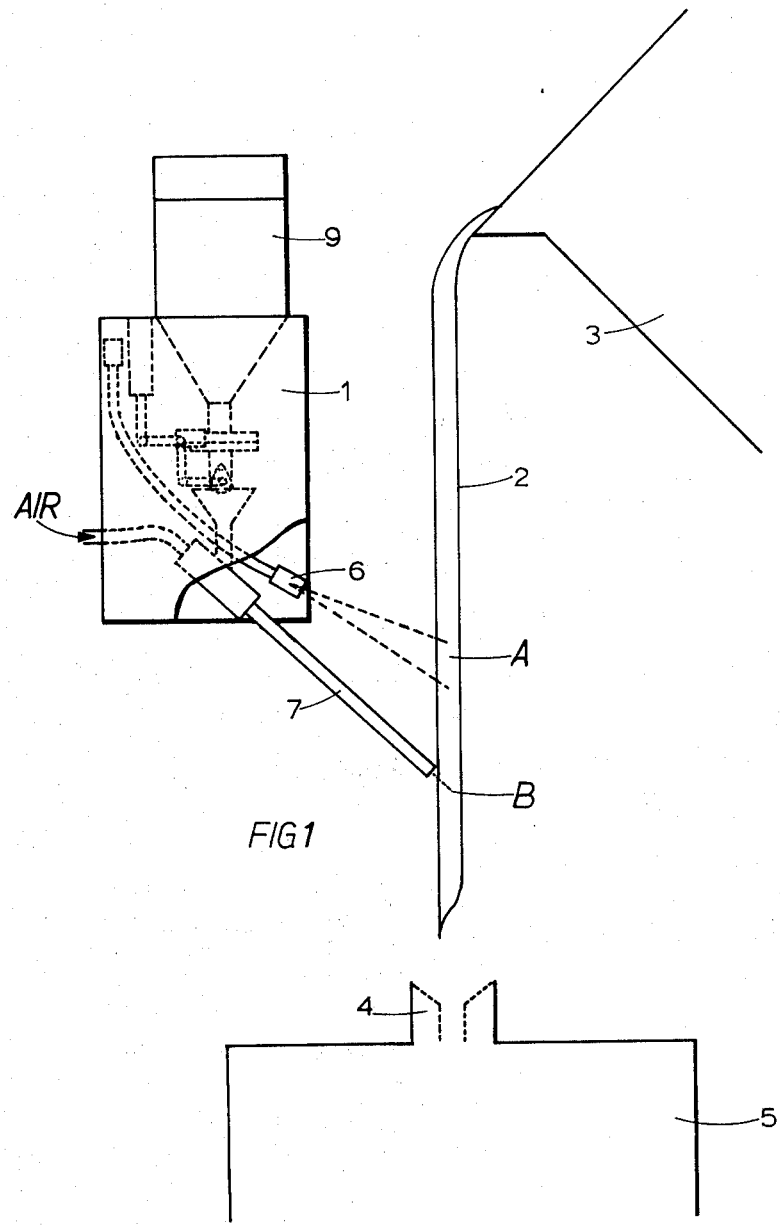
FIG. 1 is a diagrammatic cross-section through the apparatus according to the invention, showing its relationship to a vertically falling stream of molten metal being poured from a ladle into a mould.

Referring first to FIG. 1, the apparatus comprises a cabinet 1 which is arranged to be mounted (for example on an adjustable bracket, not shown) alongside the path of a freely falling vertical stream 2 of molten metal, e.g. iron, being poured from a ladle 3 into the pouring bush 4 of a casting mould 5. Mounted in the lower corner of the cabinet 1 is a detector 6, to be described in detail later, with its field of view (indicated in broken lines) directed at a location A in the falling stream. Emerging from the bottom of the casing 1 in a downwardly inclined direction is a mild steel delivery tube 7, disposed to direct a stream of additive into the falling stream 2 at a point B, spaced a predetermined distance below the location A.

Figures 2, 3:
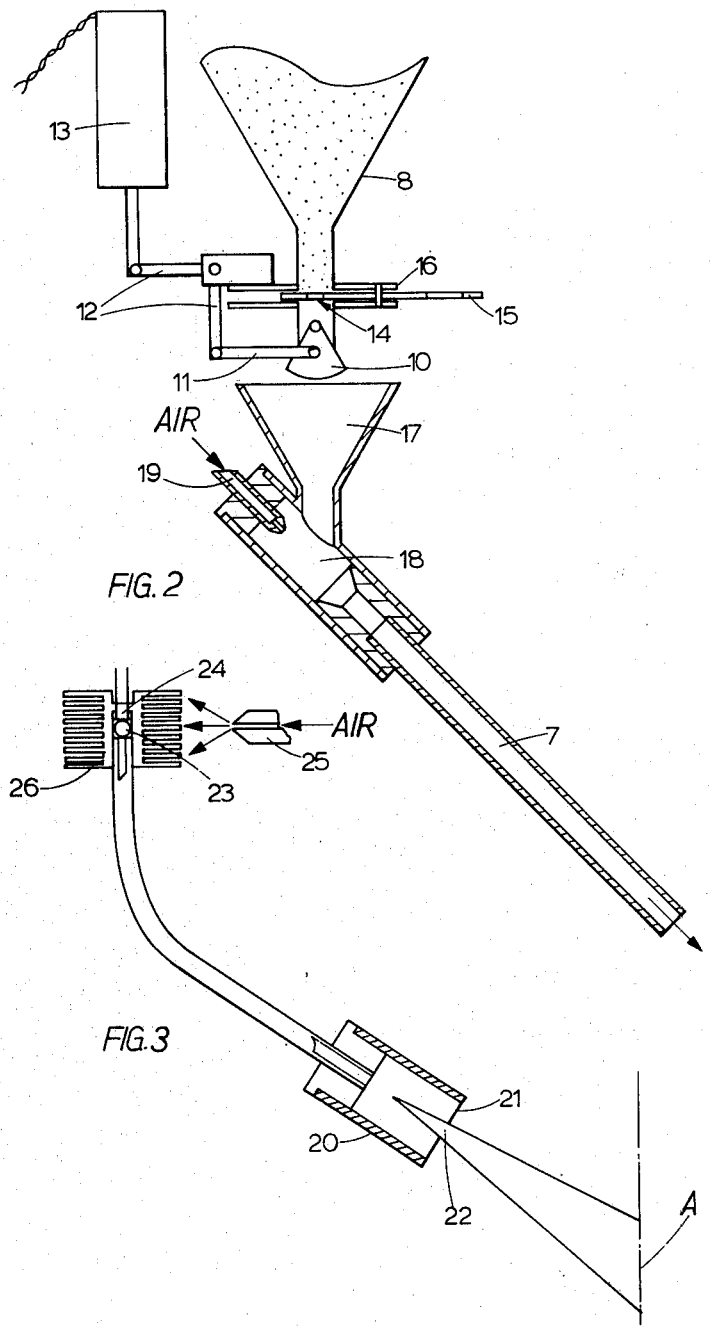
FIG. 2 is a diagrammatic view of the components involved in feeding the additive to the stream.
FIG. 3 is a diagrammatic view of the detector for sensing the presence of the stream of molten metal.

Turning now to FIG. 2, the feeding arrangement within the casing comprises a hopper 8 for the additive, mounted in the upper part of the cabinet and replenished from an external drum 9 (FIG. 1). The outlet of the lower end of the hopper is controlled by a swinging gate 10 actuated through a link 11 and bell-crank lever 12 by a solenoid 13. When the solenoid is energised the gate is open and de-energization of the solenoid closes the gate.

The flow of additive (when the gate 10 is open) is metered by virtue of the fact that it has to pass through an orifice 14 in a plate 15. This plate is in the form of a disc, which is rotatable about a pin 16 to bring any selected one of a range, (e.g. ten), of differently sized orifices into the path of the flow. On removal of the pin it is possible to remove the disc and replace it with another having a different range of sizes of orifice.

The additive falls under gravity from the hopper 8 into a funnel 17 leading in its turn into a mixing chamber 18. A blast of air from a conventional source of compressed air (not shown) is admitted to the chamber 18 through a nozzle 19 and picks up the falling additive, accelerating it forcibly down the delivery tube 7 and into the falling stream of molten metal.

The detector, shown in FIG. 3, comprises a cylindrical shield 20 with an end disc 21 in which there is a small slit 22 and a light pipe leads from the other end of the shield to a lens 23 that focusses the light onto a light-sensitive switch 24, which may be of a readily commercially available kind. The shape of the shield 20 and size of the hole 22 are such that only light from the falling stream 2 of molten metal falls on the light pipe, not light from the ladle 3, or from the metal in the pouring bush 4. Air from a nozzle 25 is blown over a heavily finned housing 26 around the switch 24 to keep it cool.

As soon as the leading end of a stream of molten metal passes the location A, the light from it activates the switch 24. Through suitable control means (to be described later with reference to FIGS. 5 and 6) this energises the solenoid 13 to open the gate 10 and allow additive to fall into the chamber 18, where there is already a state blast of air from the nozzle 19. The additive is picked up and accelerated down the tube 7 to enter the metal stream at B. By experiment it is possible to arrange that, taking into account the inertia of the solenoid and the time taken for the additive to fall from the gate 10 to the chamber 18, the arrival of the first additive at the point B coincides with the arrival of the leading end of the metal stream falling from location A. Thus no metal enters the mould untreated. In fact there is a slight excess of additive in the first part of the metal that enters the mould, by virtue of the accumulation of additive between the metering orifice 14 and the gate 10, all of which reaches the chamber 18 substantially simultaneously when the gate 10 opens.

As soon as the pouring is completed, i.e. the metal stream causes, the switch 24 is de-activated, de-energising the solenoid 13 and closing the gate 10. Thus no additive is wasted.

The rate of flow of the additive for a given orifice size will depend on the grain size of the material, and other physical characteristics. In practice one can calibrate the plate 15 and there may be a range of plates, each associated with a given quality of additive material, and each able to produce a known range of flow rates for that material by selection of the appropriate orifice. In a typical example there are ten orifices, ranging in diameter from 3 mm to 9 mm.

The apparatus may be in the form of a self-contained assembly comprising the cabinet 1 with the main mechanical components described above and a second cabinet containing the electrical power supplies and controls, and connected to the cabinet 1 through a flexible multi-core cable (which may include the compressed air supply) so that the electrical components (apart from the solenoid 13 and the switch 24) can be kept well clear of the heat and dust associated with the metal-pouring operation. The power supplies may include stand-by batteries maintained in a state of full charge so that the apparatus can function, at least for a limited time, out of range of mains power supplies.

For treating a given run of castings the required rate of flow of additive can readily be calculated, given a known desired percentage of additive, a known weight of casting, and a known average pouring time. The orifice plate 15 can then be set accordingly, having previously been calibrated.

It will be understood that, instead of detecting and adding material to a falling stream, the apparatus could be used to add material to a stream flowing in a channel. Also, instead of having pre-set flow rates, the apparatus could be arranged to deliver material at a flow rate adjusted automatically in response to a detector measuring the rate of flow of the metal stream.

Figure 4:
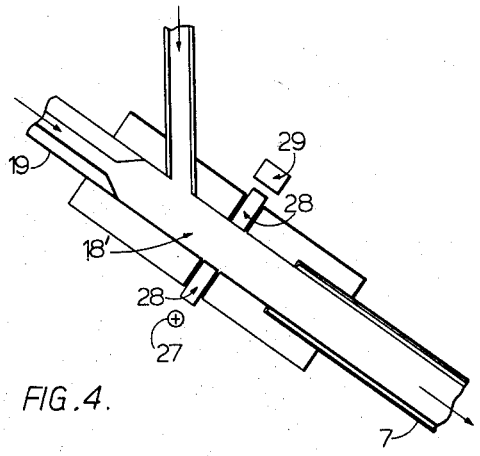
FIG. 4 shows a possible modification to the mixing chamber to detect faults.

It is desirable that it should not have to be necessary for an operator to keep a continuous watch on the apparatus to ensure that it is behaving correctly, yet equally it is important that no metal should enter the mould untreated. Failure of the inoculation system during only a single operation during a production run of castings will result in one or more faulty castings in a batch being produced and passing through undetected. FIG. 4 shows a device for monitoring the correct operation, applied to a slightly modified version of the head chamber of FIG. 2 and indicated in FIG. 4 at 18'. A lamp 27 shines a beam of light through glass rods 28 diametrically across the path of the additive passing from the chamber 18' to the delivery tube 7, this light falling on a photo-cell 29.

During correct operation of the system, the light path is interrupted by the flow of additive, this interruption ceasing when the flow halts. The resulting drop in electrical output of the cell 29 is detected, and if it coincides substantially with the period during which the solenoid 13 is energised, this indicates that all is well.

After the flow ceases, some additive may adhere to the faces of the glass rods 28. However the continued flow of compressed air will clear this adhering material after a few seconds. If the signal from the photo-cell fails to re-appear within a few seconds after the solenoid 13 is de-energised, this indicates that the chamber 18' or the delivery tube 7 is blocked or that the gate 10 is stuck in the open position. Alternatively it might be caused by the air pressure being insufficient to blow the faces of the rods 28 clear.

If the signal is maintained without reduction even when the solenoid 13 is energised, a failure of flow is indicated, and may be caused by the hopper 8 being empty, the gate 10 being stuck closed, or the funnel 17 being blocked.

Failure of the lamp 27 or the cell 29 results in the same symptoms as continued interruption of the light beam.

Thus the output from the cell 29 should decrease when the signal energizing the solenoid 13 is present and should rise again to its former value within a few seconds after that energizing signal is switched off. Any other sequence or steady state indicates a fault, either in the additive feeding system or in the monitoring system itself.

The form of the signal can be monitored by suitable electronic logic circuits fed with the signal from the cell 29 and the signal that controls the solenoid 13, and the circuits will signal an alarm or operate other mechanisms, for example to halt the metal pouring operation altogether, when a fault condition is detected. The details of the logic circuit are not illustrated as they will readily be understood by those skilled in the art.

It was stated earlier that the solenoid 13 is energised as soon as the leading end of the stream of molten metal passes the location A. The aim of this is so that the flow of additive starts arriving at the point B just as the leading end of the metal stream reaches the point B. It is also desirable that when the flow of metal stops the additive stops as just the right instant so that on the one hand the additive continues to be supplied right up to the end of the flow of metal but on the other hand, the flow of additive is not continued for a moment longer than necessary. The delays in the response of the detector 6 and the solenoid 13 are unlikely to be the same on stopping and starting and so in practice the simple system described so far, in which the detector 6 controls the solenoid 13 directly, may lead either to a waste of additive or to the last part of the metal flow not receiving additive at all.

Figure 5:
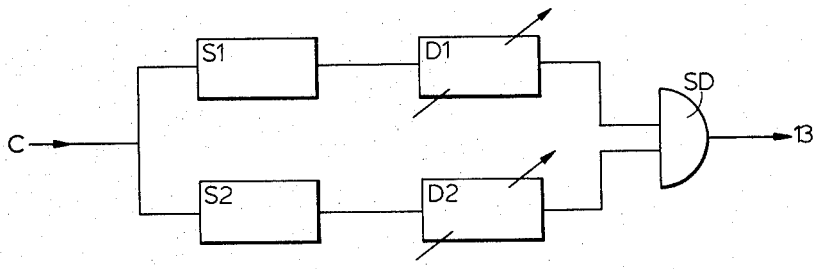
FIG. 5 is a block circuit diagram showing an adjustable form of control.

FIG. 5 illustrates in block circuit form a system which overcomes this problem and which can be applied not only to the equipment described earlier in which the presence of the metal stream is sensed to start the flow of additive but also to equipment in which a common control starts both the flow of metal (for example by tilting a ladle or operating a stopper rod or gate valve) and the flow of additive. A command signal C (which in the present example would be from the detector 6) i.e. a signal present as long as metal is being poured, is fed to two sensors, of which sensor S1 detects the start of the command signal and sensor S2 detects its end. A starting pulse from the sensor S1 is fed through a manually adjustable delay D1 and terminating pulse from the sensor S2 is fed through an adjustable delay D2, these two pulses, delayed to independently adjustable extents, being combined in a summing device SD which produces a control signal for energising the solenoid 13.

Figure 6:
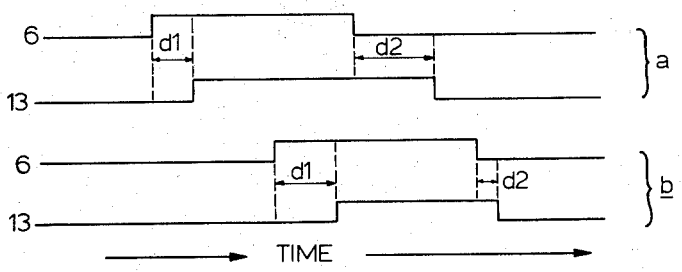
FIG. 6 is a diagram illustrating the use of the circuit of FIG. 5.

By adjusting the delay circuit D1 one can alter the delay between the response of the detector 6 and the energisation of the solenoid 13 without affecting the timing of the de-energisation, and equally by adjusting the delay circuit D2 one can alter the timing of the end of the feeding cycle without affecting the timing of the start. FIG. 6 shows two examples of possible timings; at (a) the delay d1 in the starting of the cycle is smaller than the delay d2 at the end; at (b) the relative delays are reversed. As explained earlier, the correct timings can be found by trial and error. Small adjustments may be made as necessary during operation, and where there is a change of ladle or other significant alteration in the manner of pouring, a suitable correction of the timing can be quickly introduced. In this way it is always possible to operate the additive-dispensing equipment with the maximum degree of accuracy and reliability.

It will be remembered that the molten metal stream need not be falling freely but could be in a channel or launder; the system of FIG. 5 allows easy correction for changes in the time taken for the metal to flow, for example as a result of repair of the launder or (where the command signal C is from a control for the teeming of the metal) changes in the level of metal at the start of the teeming.

We claim:

1. Apparatus for adding particulate material to a stream of flowing molten metal by blowing said material into said stream with a flow of gas under pressure, said apparatus comprising chamber means providing a path for the gas under pressure and directed towards a point in the path of said stream, reservoir means for said material, a flow path from said reservoir to said chamber means, a gate in said flow path, means for opening and shutting said gate, sensing means responsive to the presence and absence of said flowing metal stream at a predetermined location in the path of said stream, and a connection between said sensing means and said means for opening and shutting said gate whereby said gate is opened automatically in response to the presence at said location of said flowing metal stream and closed automatically in response to the absence at said location of said flowing metal stream, said connection between said sensing means and said gate opening and shutting means including adjustable delay means, the latter including first and second delay devices, said first device controlling the delay between sensing of the presence of said stream and the opening of said gate and said second device controlling the delay between sensing the absence of said stream and the closing of said gate, said devices being mutually independently adjustable.

2. Apparatus for adding particulate material to a stream of flowing molten metal by blowing said material into said stream with a flow of gas under pressure, said apparatus comprising chamber means providing a path for the gas under pressure and directed towards a point in the path of said stream, reservoir means for said material, a flow path from said reservoir to said chamber means, a gate in said flow path, means for opening and shutting said gate, sensing means responsive to the presence and absence of said flowing metal stream at a predetermined location in the path of said stream, and a connection between said sensing means and said means for opening and shutting said gate whereby said gate is opened automatically in response to the presence at said location of said flowing metal stream and closed automatically in response to the absence at said location of said flowing metal stream, said chamber means incorporating means sensing the presence of said material in said chamber means and including alarm means connected to said last-mentioned sensing means and to said metal stream sensing means and responsive to signals from said two sensing means to signal an alarm indicating failure of the flow of particulate material to keep in step with the presence of said stream of molten metal.

* * * * *